US006623155B1

(12) United States Patent
Baron

(10) Patent No.: US 6,623,155 B1
(45) Date of Patent: Sep. 23, 2003

(54) STATIC MIXER

(75) Inventor: John Michael Baron, Wilmslow (GB)

(73) Assignee: Statiflo International Limited, Wilmslow (GB)

( * ) Notice: Subject to any disclaimer, the term of this patent is extended or adjusted under 35 U.S.C. 154(b) by 0 days.

(21) Appl. No.: 09/743,497

(22) PCT Filed: May 8, 2000

(86) PCT No.: PCT/GB00/01761

§ 371 (c)(1),
(2), (4) Date: Mar. 13, 2001

(87) PCT Pub. No.: WO00/67887

PCT Pub. Date: Nov. 16, 2000

(30) Foreign Application Priority Data

May 11, 1999 (GB) ..... 9910738

(51) Int. Cl.[7] ..... B01F 5/06
(52) U.S. Cl. ..... 366/181.5; 366/337
(58) Field of Search ..... 366/181.5, 336, 366/337, 340; 48/189.4; 138/37, 39

(56) References Cited

U.S. PATENT DOCUMENTS 2,359,288 A * 10/1944 Brinen
3,051,453 A * 8/1962 Sluijters
3,337,194 A * 8/1967 Zavasnik et al.
3,620,506 A * 11/1971 So
3,783,938 A * 1/1974 Chartet
3,827,676 A * 8/1974 Brasie
4,040,256 A * 8/1977 Bosche et al.
4,072,296 A * 2/1978 Doom
4,296,779 A * 10/1981 Smick
4,352,378 A * 10/1982 Bergmann et al.
4,487,510 A * 12/1984 Buurman et al.
4,600,544 A * 7/1986 Mix
4,758,098 A * 7/1988 Meyer
4,899,812 A * 2/1990 Altoz
5,378,063 A * 1/1995 Tsukada
5,456,533 A * 10/1995 Streiff et al.
5,522,661 A * 6/1996 Tsukada
5,556,200 A * 9/1996 Ekholm et al.
5,605,399 A * 2/1997 King
5,813,762 A * 9/1998 Fleischli et al.
5,851,067 A * 12/1998 Fleischli et al.
5,967,658 A * 10/1999 Mohajer
6,000,841 A * 12/1999 Cooke et al.

FOREIGN PATENT DOCUMENTS

DE 29722388 * 5/1998
WO 92/14541 * 9/1992

* cited by examiner

*Primary Examiner*—Charles E. Cooley
(74) *Attorney, Agent, or Firm*—Woodard, Emhardt, Moriarty, McNett & Henry LLP

(57) ABSTRACT

A static mixer comprising a group of deflector elements distributed within a conduit through which a fluid flows in a direction generally parallel to an axis of the conduit. Each deflector element defines a surface which is inclined to the conduit axis such that fluid is deflected by the surface in a direction transverse to that axis. The deflector elements are positioned so as to generate an asymmetric vortex flow such that the intensities of adjacent vortices are different. The deflection elements may be in the form of, for example, asymmetric pairs of tabs, for example spaced apart pairs of tabs of different lengths. The angle of inclination of the tabs to the conduit axis may be adjustable.

11 Claims, 5 Drawing Sheets

STATIC MIXER

CROSS REFERENCE TO RELATED APPLICATIONS

The present application claims the benefit of International Patent Application No. PCT/GB00/01761 filed on May 8, 2000, which claims priority to British Patent Application No. 9910738.5 filed on May 11, 1999.

FIELD OF THE INVENTION

The present invention relates to a static mixer of the type used in conduits to generate turbulent flow in fluids within the conduits.

BACKGROUND OF THE INVENTION

Static mixers operate by modifying the flow of process components in a conduit. In one known static mixer, mixing elements are placed in the conduit to split the flow, rotate the flow stream, and then re-integrate the flow stream a number of times to achieve the desired mix. A different known type of static mixer achieves mixing by the use of deflector elements extending into the conduit to create turbulence in the flow. Turbulent flow static mixers are generally used with fluids that are not very viscous, such as water and gases.

Static mixers are often preferred in many applications as they have no moving parts and therefore require very little maintenance. Energy consumption is also reduced, as no energy is required to drive the mixer, although a pressure drop in the conduit is created by the presence of the mixer therein.

A turbulent flow static mixing device is described in U.S. Pat. No. 4,929,088, which discloses the use of rectangular deflector elements or tabs extending inwardly from the inner wall of a pipe, with the tabs set at an angle to the axis of the pipe such that the tabs extend downstream from the pipe wall. Fluid flows over the upstream faces of the tabs. In practice this system does not work very well because it generates symmetrical vortices in the flow downstream of the tabs. This creates separate vortex zones within the fluid, with little overlap between adjacent zones and little turbulence at the centre of the pipe.

Static mixers are used to mix together one fluid such as chlorine which has been injected into another fluid such as water. If it is desired to inject a small volume of one fluid into another, the use of a mixer which generates separate vortex zones causes problems because the injected fluid tends to stay within the vortex zone into which it was injected, for example either in a vortex zone created by a tab near the pipe wall, or in the less turbulent zone near the axis of the pipe. To overcome this problem, it is necessary to inject fluid into each vortex zone, which is complicated.

A further problem experienced with prior art devices is that if flow rates vary and are periodically low, this often being the case with water systems, then at low flow rates mixing of the injected fluid is inefficient, even with a complex injection pattern. This makes control of the process very difficult. For example, if the rate of injection is controlled by a downstream sensor, monitoring the concentration of the injected agent in the flow, the sensor must be sufficiently far from the injection point for reasonably efficient mixing to have been achieved by the time the fluid passes the sensor. As a result the sensor may be located a long way downstream from the injection point. This makes feedback control systems difficult to stabilise.

A further turbulent static mixer described in U.S. Pat. No. 5,456,533 comprises deflector tabs mounted on a rod which extends across the interior of a pipe. The deflectors are arranged at an angle to the axis of the pipe, with several deflectors being mounted on the rod such that adjacent deflectors are arranged on alternate sides of the rod in a staggered pattern. The tab lengths are either all the same or of very similar length, and adjacent tabs are not separated. The tabs are not arranged in dissimilar sized pairs on opposite sides of a support rod. The mixer creates some turbulence in the flow of fluid in the pipe, but results in a symmetric vortex flow which creates separate vortex zones within the fluid flow, thus leading to inefficient mixing.

It is an object of the present invention to obviate or mitigate some or all of the problems with prior art static mixers as outlined above.

SUMMARY OF THE INVENTION

According to the present invention, there is provided a static mixer comprising a group of deflector elements distributed within a conduit through which a fluid may flow in a direction generally parallel to an axis of the conduit, each deflector element defining a surface which is inclined to the conduit axis such that fluid is deflected by the surface in a direction transverse to the axis, wherein the deflector elements are positioned so as to generate an asymmetric vortex flow.

The term asymmetric is used in the sense that there is asymmetry in the vortex flow pattern about the axis of the conduit as the result of using deflector elements which are different in size, shape, or separation, or have different inclination angles with respect to the direction of flow of fluid in the conduits.

Preferably the deflector elements are arranged in pairs of elements having different characteristics, for example rectangular strips of different lengths. The two deflector elements of a pair may extend from a common upstream edge and define between them on a downstream side an included angle of less than 180°, e.g. 60°. The two deflector elements of a pair may be equally inclined to the conduit axis, and adjacent pairs of elements may be spaced apart.

Preferably the deflector elements are supported on at least one mounting element extending across the interior of the conduit. Two or more groups of elements may be provided, the mounting elements of the two groups being spaced apart in the direction of the axis and mutually inclined.

Preferably the angle of inclination of at least one of the deflector element surfaces to the conduit axis is adjustable. The angle of inclination may be adjusted in response to fluctuations in flow conditions within the conduit, for example downstream of the deflector elements.

The invention also provides a static mixer comprising a group of deflector elements distributed within a conduit through which a fluid may flow in a direction generally parallel to an axis of the conduit, each deflector element defining a surface which is inclined to the conduit axis such that fluid is deflected by the surface in a direction transverse to the axis, wherein the angle of inclination of at least one of the deflector element surfaces to the conduit axis is adjustable.

BRIEF DESCRIPTION OF THE DRAWINGS

1

DESCRIPTION OF THE ILLUSTRATED EMBODIMENTS

Figure 1:
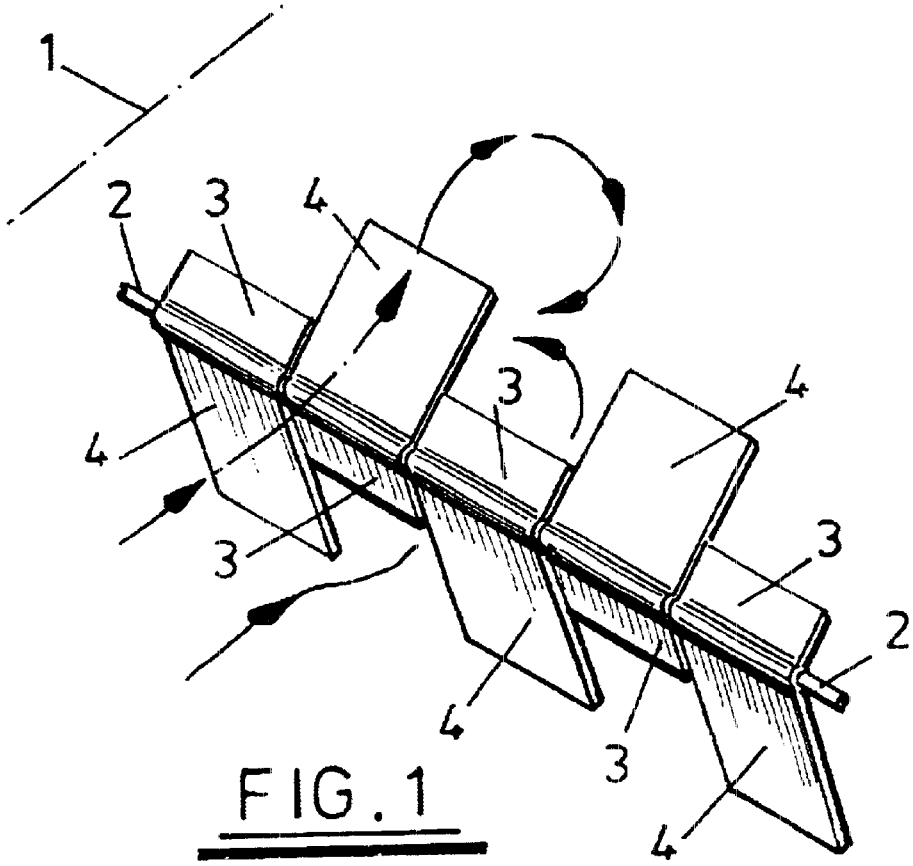
FIG. 1 is a schematic perspective view of deflectors of a static mixer according to a first embodiment of the present invention.
Figure 2:
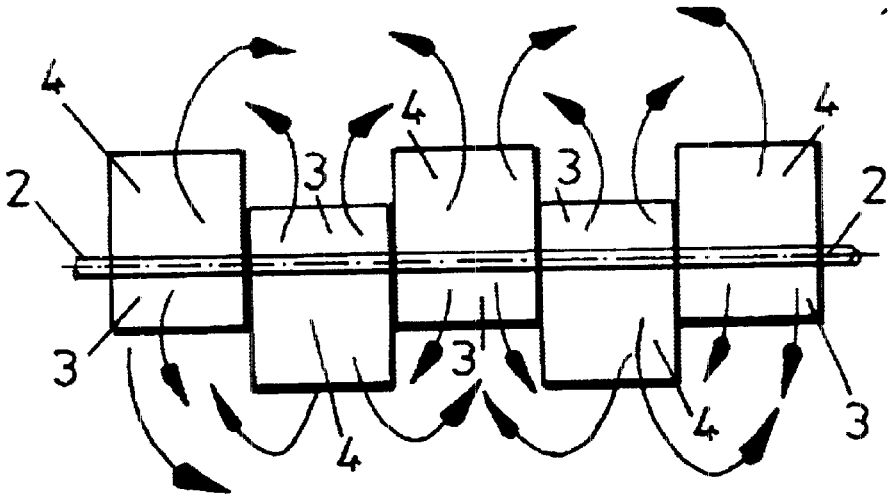
FIG. 2 is a view of the deflectors of FIG. 1 looking in the direction of fluid flow.

Referring to the drawings, the illustrated static mixing devices are mounted within a pipe, the wall of which is indicated by broken line 1. The mixer comprises a rod 2 on which a series of pairs of deflector elements 3, 4 are supported, five pairs being provided in the group of FIGS. 1 and 2, and three pairs being provided in the group of FIG. 3. It will of course be appreciated that the number of pairs used will be selected to suit a particular application, and thus the number of pairs could be other than three or five. The deflector elements 3, 4 are attached to the rods 2 such that they subtend an angle between them, which in the illustrated example is approximately 90°, each being inclined at 45° to the axis of the pipeline. The correct placement angle of the deflector elements 3, 4 will be determined in practice by reference to the amount of turbulence to be required in a particular process. A larger angle between the deflector elements will create a greater amount of turbulence, but will cause a greater pressure drop in fluid flowing in the pipeline.

Figure 3:
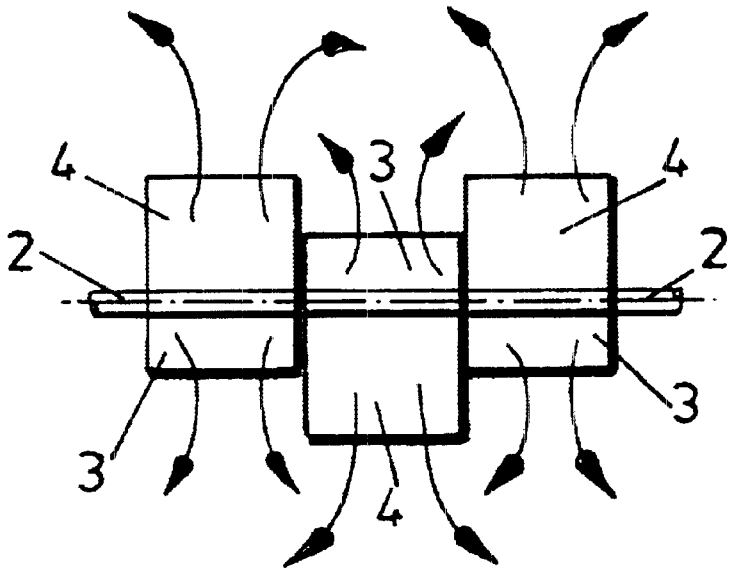
FIG. 3 is a view of an alternative arrangement of deflectors in accordance with a second embodiment of the invention, again looking in the direction of fluid flow.
Figure 4:
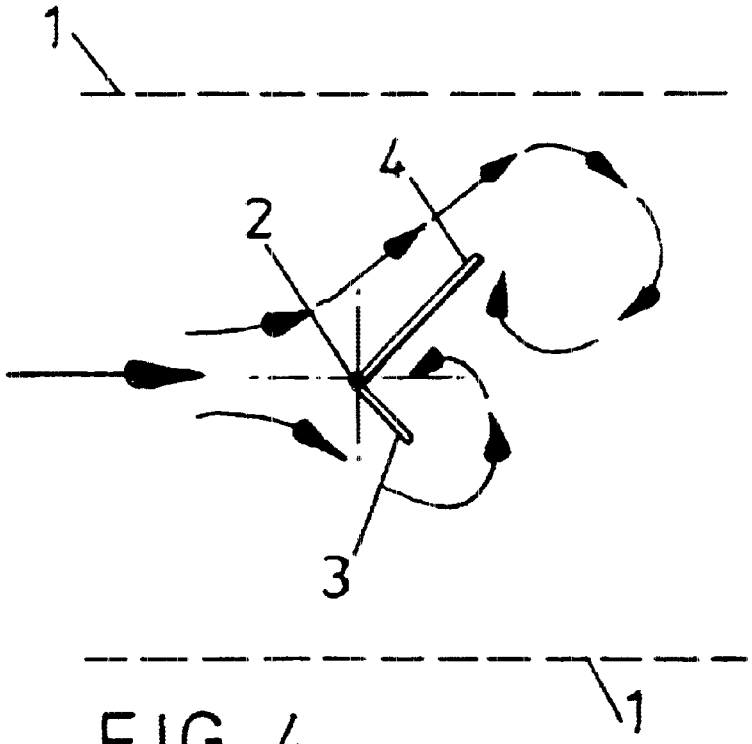
FIG. 4 is a side view of one pair of deflector elements used in the arrangements of FIGS. 1 to 3.

The deflector elements 3, 4 are each of a generally rectangular shape, are of the same width, but are of different lengths. In the illustrated embodiments, deflector element 3 is shorter than deflector element 4. The deflector elements 3, 4 are placed on the supporting rod so that a short element 3 of one pair is next to the long element 4 of an adjacent pair. In the embodiment shown in FIG. 1 and 2, five deflector pairs are attached to the supporting rod 2. However, a different number of deflector element pairs can be used, depending on the size and shape of the pipeline and the process application, for example three pairs as shown in FIG. 3.

The deflector elements 3, 4 are formed of any suitable material that will withstand fluid flows in the pipeline and that will resist corrosion or degradation due to the fluids flowing in the pipeline. Stainless steel may be used in many applications.

In use, the mixing device may be installed in a pipeline downstream of an injection point for an agent that is to be mixed into the main fluid flow. For example, the mixing device may be used in a situation where it is desired to inject chlorine into water, to provide a disinfectant action. For example, chlorine could be injected adjacent the common edge of each pair of deflector elements 3, 4 such that five injection points would be provided in the embodiment of FIGS. 1 and 2. An injection system could be incorporated in rods used to support the deflector elements. A self-cleaning mechanism could also be provided either immediately upstream of the deflector elements, or possibly incorporated into the deflector element assembly, to enable use of the mixer in waste water systems.

The mixing device may be mounted on a collar placed in the pipeline or may be welded or otherwise secured in the pipeline. The mixing device can be used in pipelines with any cross sectional shape or size, with adjustments being made to the number and size of the deflector elements and/or fixing elements to affix the mixing device in the pipeline to take account of the particular process application.

As fluid flows past the mixing device, turbulence is created in the flow by the deflector elements. This turbulent flow is indicated in the drawings by arrows. The fluid travels over the upstream faces of the deflector elements and generates vortices downstream of the mixing device. Due to the asymmetrical nature of the deflector elements, the vortices thus created in the flow are asymmetrical and mix with each other and the vortices generated by adjacent deflector element pairs downstream of the mixing device. The vortices generated by the deflector elements of one pair are of different intensities. The interaction of the vortices creates a greater degree of mixing of the fluid than is achieved by having a symmetrical turbulent flow, thus allowing mixing to be achieved in a shorter length of pipeline than with prior art turbulent flow static mixing devices.

The asymmetry of the deflector elements is achieved in the illustrated embodiments by having deflector elements of different lengths. It should be appreciated that an asymmetrical turbulent flow may also be achieved by the use of deflector elements which differ in other ways, for example in terms of their angle of inclination to the axis of the pipeline, or in terms of their shape. For example, the deflector elements could be trapezoidal rather than rectangular. It will also be appreciated that the necessary deflector element structure can be produced from a single sheet of metal, for example in the case illustrated in FIG. 1 by forming all of the ten deflector elements from an appropriately cut single sheet of metal which is then bent to provide the illustrated profile.

Figure 5:
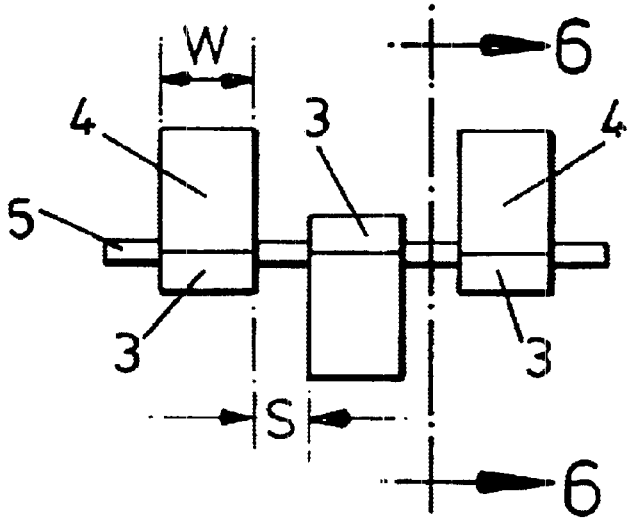
FIGS. 5 and 6 illustrate a third embodiment of the invention, FIG. 6 being a view on the line 6—6 of FIG. 5.
Figure 6:
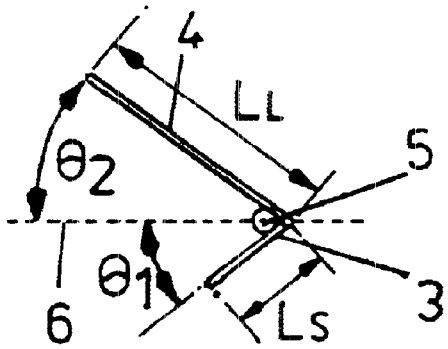

Referring to FIGS. 5 and 6, a third embodiment of the invention is illustrated. In the arrangement of FIGS. 5 and 6, three pairs of spaced apart deflector elements are provided, each including a relatively short tab 3 of length $L_s$ and a relatively long tab 4 of length $L_L$. Each tab has the same width W and adjacent pairs of tabs are separated by gaps of width S. The deflectors are mounted on a support rod 5, the relatively short tabs are inclined to the axis of the conduit (indicated by line 6) by an angle $\theta_1$ and the relatively long tabs 4 are inclined to the axis 6 at angle $\theta_2$.

Tests have been conducted with a three deflector element array as shown in FIG. 6 positioned within a pipe of nominal internal diameter of 100 mm. The best results have been achieved with deflectors having the following dimensions:

Length $L_L$ of tab 4: 40 mm

Length $L_s$ of tab 3: 10 mm

Width W of tabs and 4: 20 mm

Spacing S between adjacent tabs: 10 mm

Tab thickness: 1 mm

Outside diameter of rod 5: 3 mm

Angles $\theta_1$ and $\theta_2$: 30 mm

The above dimensions are scaleable in proportion to pipe cross section.

Figure 7:
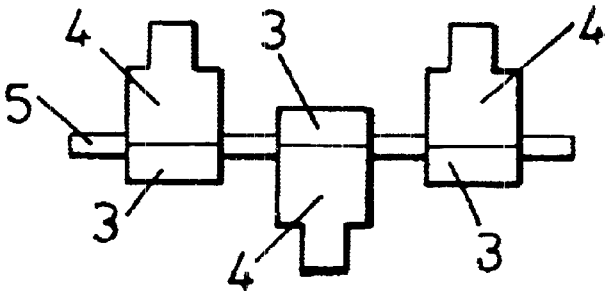
FIGS. 7 and 8 illustrate fourth and fifth embodiments of the invention.

Experiments have also been conducted with an arrangement as shown in FIG. 7 in which three pairs of tabs 3, 4 are provided on a rod 5, the relatively long tabs 4 having a first rectangular section of the same width of that of the tab 3 and an end extension of reduced width. Such an arrangement does generate an increased number of vortices as compared with the arrangement of FIG. 5 but this does not seem to result in any significant improvement in mixing performance. Additional costs are incurred however in forming the tabs as shown in FIG. 7.

Figure 8:
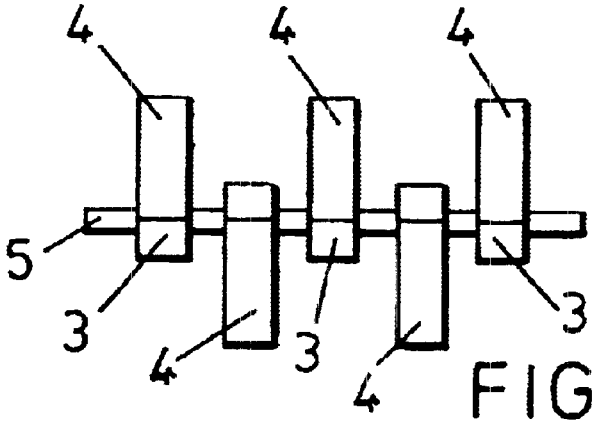

Further experiments have been conducted with an arrangement such as that shown in FIG. 8 which comprises five pairs of tabs 3, 4 as compared with the three pairs in the embodiments of FIGS. 5 and 7. Some increase in the pressure drop across the mixer results with the arrangement of FIG. 8 without any measurable improvement in mixing performance. Nevertheless the arrangement of FIG. 8 does provide an acceptable performance in some circumstances.

Figure 9:
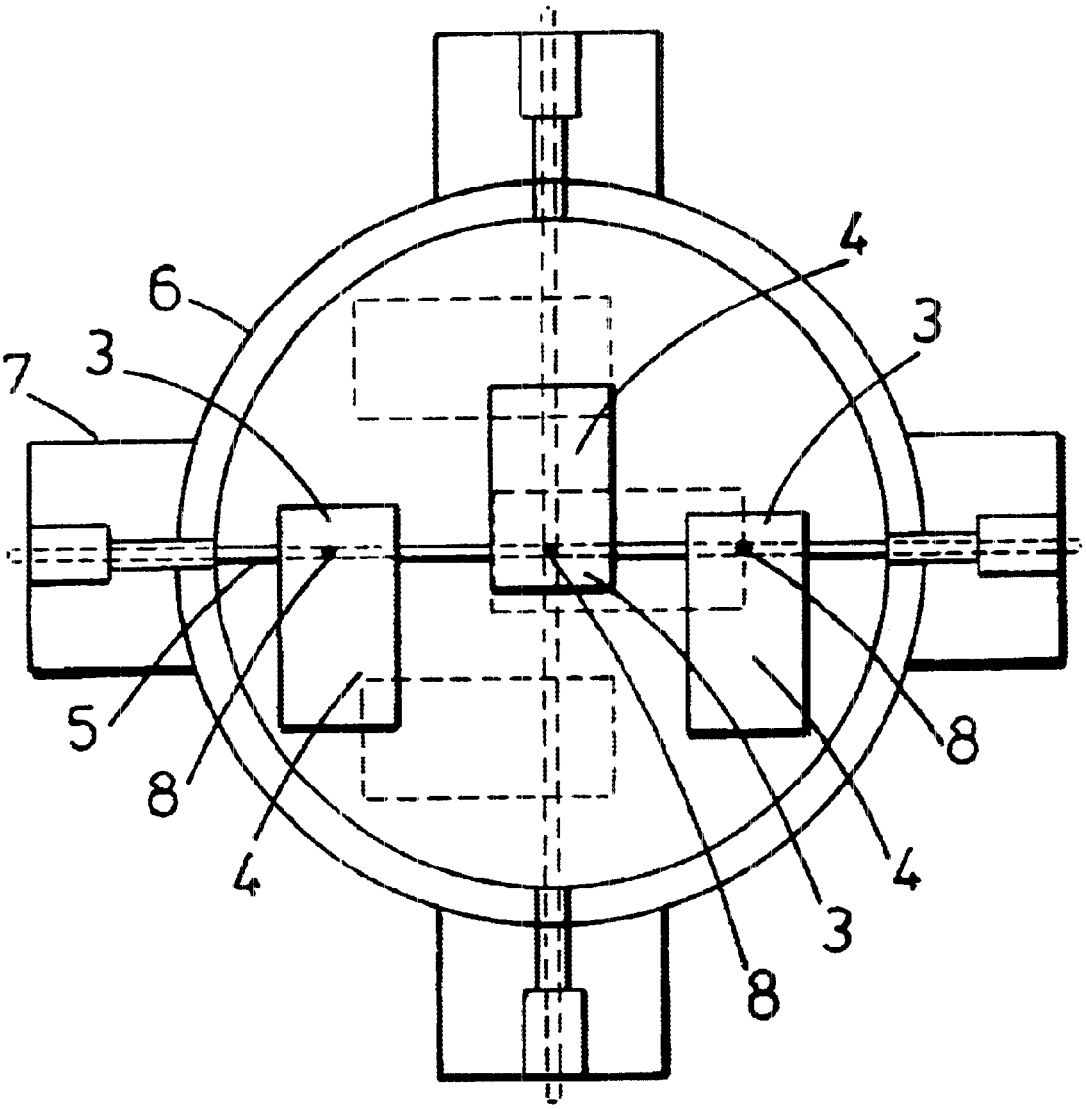
FIG. 9 illustrates the relative disposition of two axially spaced deflectors of the type illustrated in FIGS. 5 and 6.

FIG. 9 illustrates the disposition of two axially spaced sets of tabs such as are illustrated in FIGS. 5 and 6. It will be seen that the axially separated pairs of tabs are arranged on rods 5 which are mutually perpendicular. Thus longer tabs 4 extend across much of the cross-section of three of the four quadrants defined between the two inclined rods 5. The quadrant to the top right hand corner in FIG. 9 is not occupied to a substantial extent by one of the longer tabs 4. This may mean that mixing within this quadrant is less efficient than in the other three quadrants. This effect could be overcome by providing a third set of three pairs of deflector tabs with the rod 5 of the downstream set extending parallel to that of the upstream set but the longer tabs 4 of the downstream set extending upwards in FIG. 9 rather than downwards in FIG. 9 as is the case with the upstream set.

In summary, experimental results obtained with the arrangements illustrated in FIGS. 5 to 9 indicate that although a single set of deflectors does provide efficient mixing the downstream length of pipe necessary to achieve a predetermined degree of mixing can be reduced by adding additional sets of deflectors. Three pairs of deflector tabs per set appears to be the optimum, providing the best compromise between pressure drop and mixing efficiency. Five pairs of deflector tabs per set results in a higher pressure drop but little or no improvement in mixing. Inclining the tabs of different length at equal angles of 30° to the pipe axis provides good results but may not be optimum in some circumstances. Simple rectangular tabs as shown in FIG. 5 appear to provide substantially the same results as more complex tab shapes as illustrated in FIG. 7. Mixing efficiency increases with the number of deflector sets spaced apart in the axial direction although no appreciable improvement occurs if more than five axially spaced sets are provided.

In the arrangement shown in FIG. 9, a chemical additive such as chlorine may be introduced through dose point inlets 8 at the apex of each of the three pairs of deflector tabs of the upstream set of deflector tabs. This ensures that the additive is effectively mixed as it is carried by the flow past each of the sets of deflectors. The chemical additive could be introduced via a small aperture tube, for example a hollow tube with three holes in its side. Fluid injection apparatus could be incorporated in the structure used to support the pairs of deflectors.

As mentioned above, the angle of inclination of the deflector elements to the flow direction is best determined by reference to the process conditions in which the mixing device is to be used. One of the most significant factors in any particular process is the rate of flow of fluid in the pipeline. In applications in which fluid flow rates vary, which is often the case in water systems, it may be highly advantageous to modify the deflector element inclination angles as a function of flow rate, or as a function of other variable flow conditions. For example, in the case of the embodiment illustrated in FIG. 1, the five uppermost deflector elements could be mounted to be rotatable on a first support rod (that is three elements 3 and two elements 4) and the lower five deflector elements could be mounted to rotate on a second support rod (that is three deflector elements 4 and two deflector elements 3). The included angle between the two sets of deflector elements could then be controlled as a function of flow rate, for example the included angle between the two sets of deflector elements increasing with decreasing flow rate. This would make it possible to provide efficient mixing despite substantial variations in flow rate.

In some applications, the asymmetrical deflector elements will establish an oscillating vortex effect so that the pressure at any one point downstream of the mixing device cycles up and down. This oscillatory effect could be monitored so as to make it possible to monitor the efficiency of the mixing process.

Tests have been conducted with the arrangement illustrated in FIGS. 5 and 6 to assess the result of varying the angles $\theta_1$ and $\theta_2$. In particular, tests were conducted with both $\theta_1$ and $\theta_2$ equal to 15°, then 60°, then 30° as illustrated in FIG. 6. These tests appeared to indicate that an angle of 30° was in many circumstances close to optimum, but particularly at high flow rates subtle effects could be generated by relatively small variations in the angles $\theta_1$ and $\theta_2$. Thus in such applications it may well be advantageous to provide a variable geometry in which angles $\theta_1$ and $\theta_2$ can be selectively adjusted.

Figure 10:
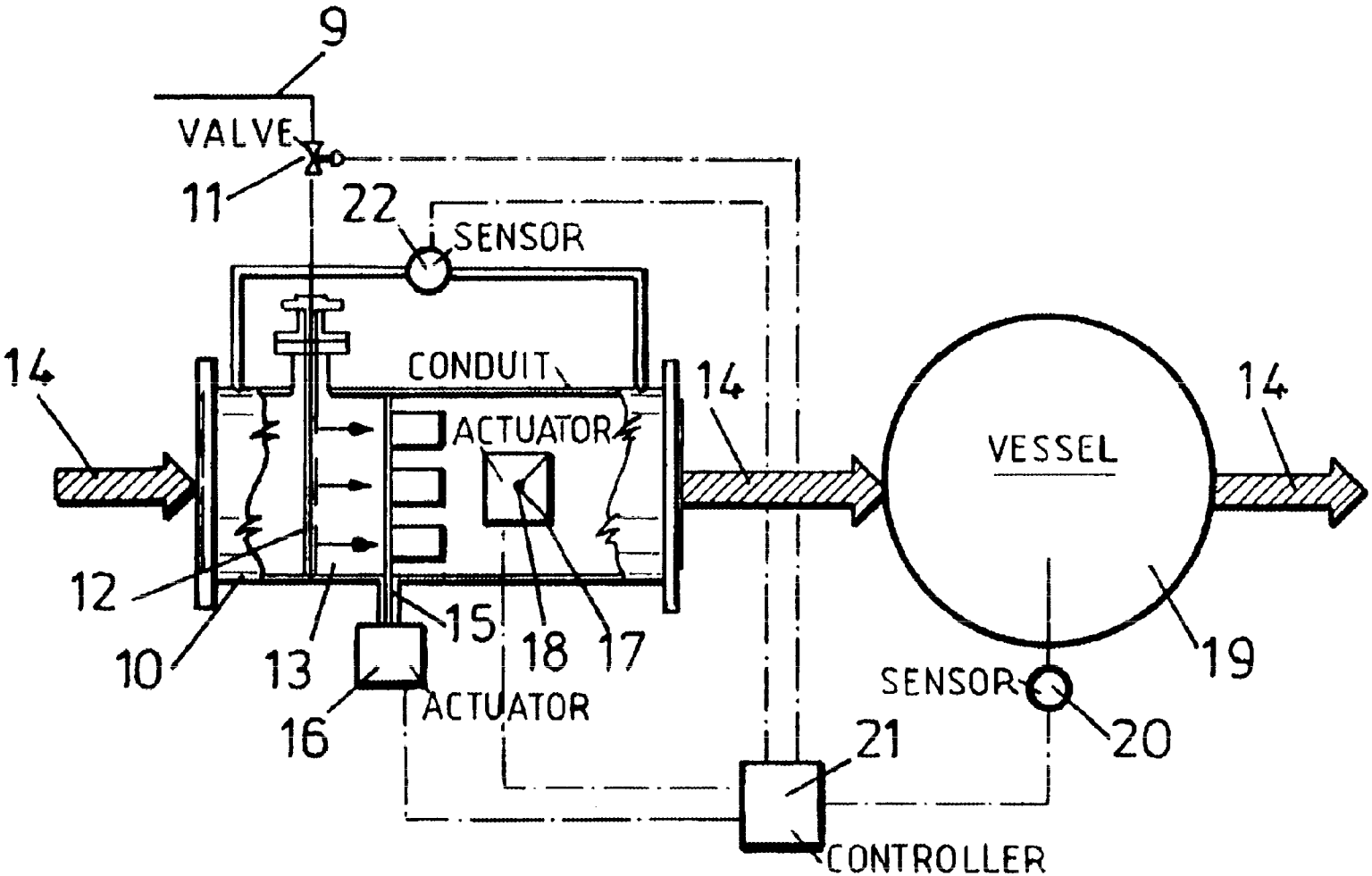
FIG. 10 illustrates a variable geometry static mixer incorporating two axially spaced deflectors as illustrated in FIG. 9.

FIG. 10 illustrates a variable geometry static mixer in accordance with the present invention incorporated into a chemical additive injection control mechanism. A chemical additive is introduced via line 9 into a conduit 10, the line a communicating via a valve 11 with a fluid distribution pipe 12 extending across the conduit. The pipe 12 injects three streams of the chemical additive into the fluid flow within the conduit as indicated by arrows 13. The fluid flow through the system is indicated by arrows 14.

Each of the injected chemical additive streams is directed to the apex of a respective pair of asymmetrical tabs such as those illustrated in FIGS. 5 and 6. The pairs of tabs are mounted on a control rod assembly 15 controlled by a positioning actuator 16 such that the angles $\theta_1$ and $\theta_2$ (FIG. 6) can be varied but are always equal. A similar actuator 17 drives a further control rod assembly 18 which is perpendicular to the conduit axis and at right angles to the control rod assembly 15. Thus the arrangement is as illustrated in FIG. 9. The two mutually inclined groups of deflector elements ensure efficient mixing within the conduit 10. Fluid from the conduit passes into a downstream vessel 19 which could be for example a clarifier, chlorinator or reactor. Conditions within the vessel 19 are monitored by a sensor 20 the output of which provides an input to a controller 21. A further input to the controller 21 is derived by a differential pressure sensor 22 which monitors the pressure both upstream and downstream of the static mixer. The two inputs provided to the controller 21 are used as the basis for generating appropriate outputs to the additive injection control valve 11 and the deflector element controllers 16 and 17.

Thus the system of FIG. 10 makes it possible to both control the rate at which chemical additive is injected into the system and to control the performance of the static mixer in dependence upon conditions downstream of the static mixer. Active process control is thus achieved.

What is claimed is:

1. A static mixer comprising a group of deflector elements distributed within a conduit through which a fluid may flow in a direction generally parallel to an axis of the conduit, characterized in that the deflector elements are arranged in pairs of elements, the two deflector elements of each pair extending in a downstream direction from a common upstream leading edge and positioned generally opposite one another relative to the axis of the conduit to define between them on a downstream side an included angle of less than 180°, each of the two deflector elements defining a surface which is inclined to the conduit axis such that fluid is deflected by the inclined surface in a direction transverse to the axis of the conduit, and the two deflector elements of each pair having different configurations such that asymmetric vortices are generated by the two elements of the pair.

2. A static mixer according to claim 1, wherein the deflector elements of each pair extend for different lengths from the common upstream edge.

3. A static mixer according to claim 2, wherein adjacent pairs of deflector elements are positioned such that a short element of one pair is next to a long element of the adjacent pair.

4. A static mixer according to claim 2, wherein the deflector elements of each pair are rectangular.

5. A static mixer according to claim 1, comprising three pairs of deflector elements spaced apart across the conduit.

6. A static mixer according to claim 1, wherein spaces are defined between adjacent pairs of elements.

7. A static mixer according to claim 1, wherein the deflector elements are supported on at least one mounting element extending across the interior of the conduit.

8. A static mixer according to claim 7, comprising at least two groups of elements with each group being supported on a respective mounting element extending across the interior of the conduit, the mounting elements being spaced apart in the direction of the conduit axis and extending in mutually inclined directions.

9. A static mixer according to claim 1, wherein the angle of inclination of at least one of the deflector element surfaces relative to the conduit axis is adjustable.

10. A static mixer comprising a group of deflector elements distributed within a conduit through which a fluid may flow in a direction generally parallel to an axis of the conduit, each deflector element defining a surface which is inclined to the conduit axis such that fluid is deflected by the surface in a direction transverse to the axis, characterized in that the deflector elements are arranged in pairs of elements, the two deflector elements of each pair extending from a common upstream edge and positioned generally opposite one another to define between them on a downstream side an included angle of less than 180°, and the two deflector elements of each pair having different configurations such that asymmetric vortices are generated by the two elements of the pair, the two deflector elements of each pair are equally inclined relative to the conduit axis.

11. A static mixer according to claim 10, wherein each deflector element is inclined at an angle of 30° relative to the conduit axis.

* * * * *